US007794830B2

(12) United States Patent
Kusoffsky et al.

(10) Patent No.: US 7,794,830 B2
(45) Date of Patent: Sep. 14, 2010

(54) SINTERED CEMENTED CARBIDES USING VANADIUM AS GRADIENT FORMER

(75) Inventors: Alexandra Kusoffsky, Lidingö (SE); Susanne Norgren, Huddinge (SE)

(73) Assignee: Sandvik Intellectual Property AB, Sandviken (SE)

( * ) Notice: Subject to any disclaimer, the term of this patent is extended or adjusted under 35 U.S.C. 154(b) by 5 days.

(21) Appl. No.: 11/658,055

(22) PCT Filed: Jun. 27, 2006

(86) PCT No.: PCT/SE2006/000785

§ 371 (c)(1),
(2), (4) Date: Apr. 16, 2008

(87) PCT Pub. No.: WO2007/001226

PCT Pub. Date: Jan. 4, 2007

(65) Prior Publication Data

US 2009/0011267 A1 Jan. 8, 2009

(30) Foreign Application Priority Data

Jun. 27, 2005 (SE) ..... 0501489

(51) Int. Cl.
*B32B 18/00* (2006.01)
*C22C 29/02* (2006.01)

(52) U.S. Cl. ..... 428/325; 51/307; 51/309; 75/241; 419/14; 419/15; 419/26; 419/38; 428/217; 428/336; 428/469; 428/698

(58) Field of Classification Search ..... 51/307, 51/309; 428/217, 325, 332, 336, 469, 698; 75/238, 241; 419/14, 15, 26, 38
See application file for complete search history.

(56) References Cited

U.S. PATENT DOCUMENTS

| | | | | |
|---|---|---|---|---|
| 4,277,283 | A | 7/1981 | Tobioka et al. | |
| 4,443,255 | A * | 4/1984 | Brown et al. | 75/242 |
| 4,548,786 | A | 10/1985 | Yohe | |
| 4,610,931 | A | 9/1986 | Nemeth et al. | |
| 4,649,084 | A | 3/1987 | Hale et al. | |
| 4,830,930 | A | 5/1989 | Taniguchi et al. | |
| 5,624,766 | A * | 4/1997 | Moriguchi et al. | 407/119 |
| 5,654,035 | A | 8/1997 | Ljungberg et al. | |
| 6,299,992 | B1 | 10/2001 | Lindskog et al. | |

FOREIGN PATENT DOCUMENTS

| | | |
|---|---|---|
| EP | 0 569 696 | 10/1997 |
| EP | 0 603 143 | 2/2000 |
| EP | 0 737 756 | 7/2002 |
| EP | 0 937 781 | 9/2003 |
| JP | 63-011646 | * 1/1988 |
| WO | 03/104507 | 12/2003 |

* cited by examiner

*Primary Examiner*—Archene Turner
(74) *Attorney, Agent, or Firm*—Drinker Biddle & Reath LLP

(57) ABSTRACT

The present invention relates to a cutting tool insert for turning consisting of a cemented carbide substrate and a coating. The cemented carbide substrate comprises WC, binder phase, and vanadium containing cubic carbide phase with a binder phase enriched surface zone essentially free of cubic carbide phase. The thermal properties of the vanadium-containing cubic phase, has turned out to give excellent resistance to thermal cracking of the insert.

19 Claims, 3 Drawing Sheets

SINTERED CEMENTED CARBIDES USING VANADIUM AS GRADIENT FORMER

The present invention relates to cemented carbides with a binder enriched surface zone, a so-called gradient zone. The gradient zone is essentially free from cubic carbides or carbonitrides. The use of vanadium as a gradient former will create unique properties regarding the resistance to thermal cracking.

Coated cemented carbide inserts with binder phase enriched surface zone are today used to a great extent for machining of steel and stainless materials. Thanks to the binder phase enriched surface zone, an extension of the application area for cutting tool material has been obtained.

Methods or processes to make a cemented carbide containing WC, cubic phase, comprising of at least one carbide or carbonitride (herein referred to as "cubic phase"), and binder phase with binder phase enriched surface zones are within the techniques referred to as gradient sintering and are known through a number of patents and patent applications. According to U.S. Pat. Nos. 4,277,283 and 4,610,931 nitrogen containing additions are used and sintering takes place in vacuum whereas according to U.S. Pat. No. 4,548,786 the nitrogen is added in gas phase. Hereby in both cases a binder phase enriched surface zone essentially depleted of cubic phase is obtained. U.S. Pat. No. 4,830,930 describes a binder phase enrichment obtained through decarburization after the sintering whereby binder phase enrichment is obtained which also contains cubic phase.

In U.S. Pat. No. 4,649,084 nitrogen gas is used in connection with sintering in order to eliminate a process step and to improve the adhesion of a subsequently deposited oxide coating. In EP patent 569696 the binder phase enriched zone is obtained with the presence of Hf and/or Zr. In EP patent 737756 the same effect is achieved with Ti present in the cemented carbide. In these patents it is shown that cubic carbide formers of group 4A (Ti, Zr, Hf) can be used to achieve a binder enriched surface zone.

EP-A-603143 discloses cemented carbide with binder phase enriched surface zone said cemented carbide containing WC and cubic phases in a binder phase in which the binder phase enriched surface zone has an outer part essentially free of cubic phase and an inner part containing cubic phase and stratified binder phase layers. The amount of binder phase is between 2 and 10 wt-%. The cubic phase can contain varying amount of titanium, tantalum, niobium, vanadium, tungsten and/or molybdenum. The binder phase enriched surface zone as well as an up to 300 μm thick zone below it contains no graphite. However, in the interior there is a C-porosity of C04-C08.

From a fracture mechanical point of view, an enrichment of binder metal in a surface zone means that the ability of the cemented carbide to absorb deformation and stop growing cracks from propagating. In this way a material is obtained with improved ability to resist fracture by allowing greater deformations or by preventing cracks from growing, compared to a material with mainly the same composition but homogenous structure. The cutting material, thus, exhibits a tougher behavior. However, it has turned out that cutting inserts with binder phase enriched surface zones have a reduced ability to withstand wear when cutting operations include thermal cycling of the cutting edge, such as interrupted cut with coolant. This wear type includes cracking of the coating and subsequent cracking of the surface zone of the cemented carbide body which leads to that parts of the coating and to some extent also parts of the surface zone are "pulled out" giving an uneven and rapid wear on the rake face and in the edge line of the cutting insert.

It is an object of the present invention to provide a cemented carbide insert with a binder phase enriched surface zone with a combination of high toughness and high deformation resistance and increased resistance to thermal cracking.

Surprisingly it has been found that a cemented carbide insert with a binder phase enriched surface zone with a combination of high toughness and high deformation resistance and increased resistance to thermal cracking is obtained if V from group 5A is used as gradient former and if the content of Ti is low or 0.

Figure 1:
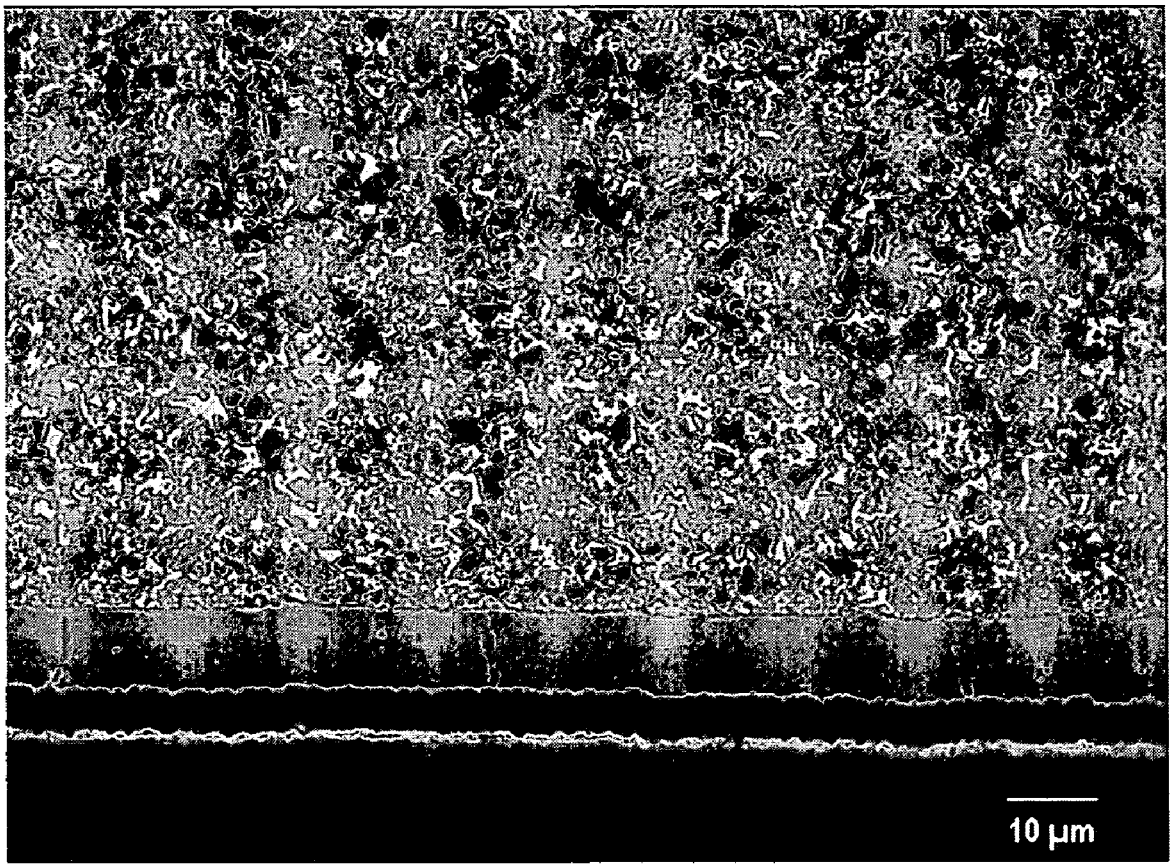
FIGS. 1 and 2 show in 500× magnification the structure of a binder phase enriched surface zone of a coated insert according to the invention.
Figure 2:
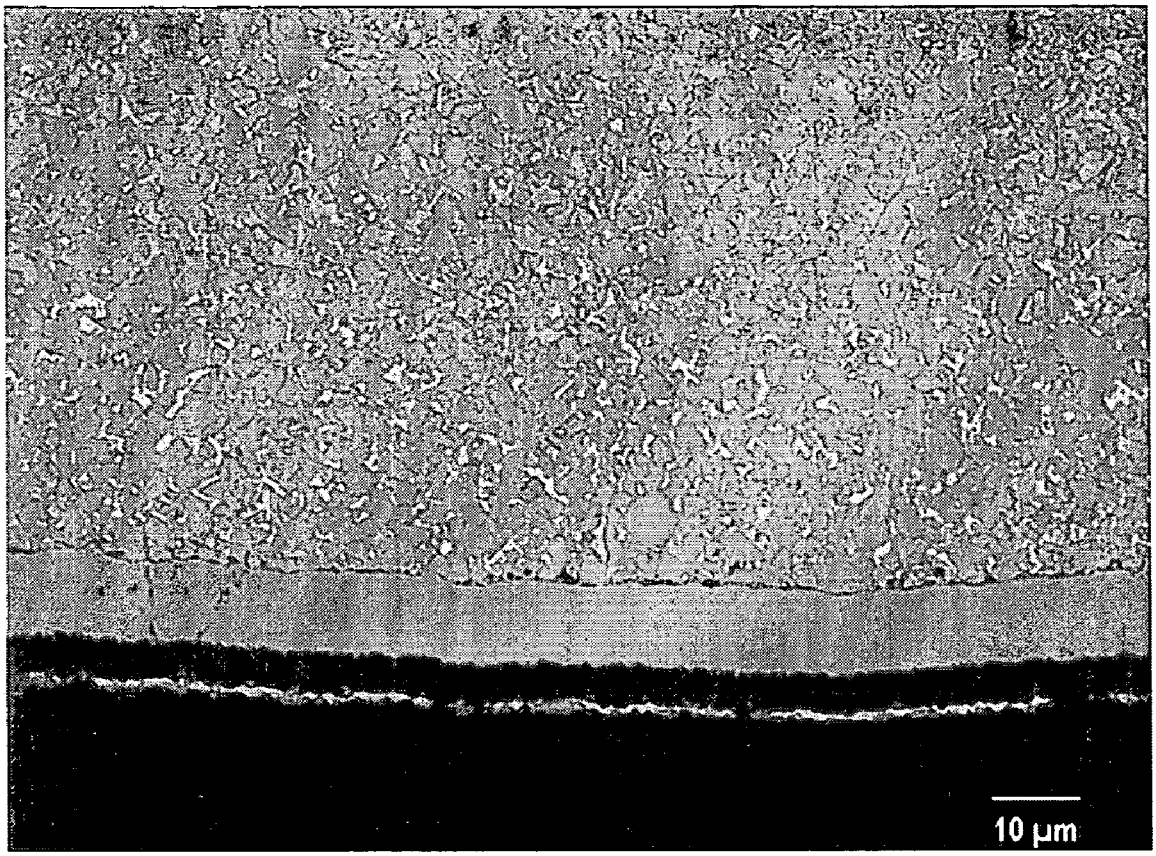

The present invention concerns cemented carbides used in turning operations consisting of a first phase based on tungsten carbide, WC, having an average grain size larger than 1.5 μm, preferably smaller that 3 μm, a metallic binder phase based on Co and/or Ni and finally at least one additional cubic phase comprising at least one solid solution carbonitride containing vanadium. The cemented carbide has a <50, preferably 10-35 μm thick binder phase enriched surface zone essentially free of cubic phase. The binder phase content of the binder phase enriched surface zone has a maximum of 1.2-3 times the nominal binder phase content. The WC has an average grain size larger than 1.5 μm close to the surface in the gradient zone as well as in the center of the cemented carbide. The composition of the cemented carbide is 3-20 wt-% Co, preferably 4-15 wt-% Co and most preferably 5-13 wt-% Co, 1-15 wt-% V and preferably 2-8 wt-% V. Other cubic carbide forming elements soluble in the cubic phase, except for Ti, from group 4a and or 5a can be added, preferably <4 wt-% Nb, most preferably 0.2-3 wt-% Nb, and preferably <10 wt-% Ta, most preferably 1-8 wt-% Ta and as rest WC, 70-92 wt-%, preferably 75-90 wt-% with no free graphite present in the microstructure. Ti can only be present in minor amounts, <1 wt-%, preferably <0.5 wt-% most preferably on the level of technical impurity or 0 wt-%. The total sum of V and other elements soluble in the cubic phase except W is 1-15 wt-%, preferably 2-10 wt-%. The weight-ratio between the amount of Ti compared to the amount of V should be less then 0.5, preferably less then 0.2.

The cobalt binder phase is alloyed with a certain amount of W giving the cemented carbide cutting insert its desired properties. W in the binder phase influences the magnetic properties of cobalt and can hence be related to a value, CW-ratio, defined as $$\text{CW-ratio} = \text{magnetic-\% Co}/\text{wt-\% Co}$$

where magnetic-% Co is the weight percentage of magnetic Co and wt-% Co is the weight percentage of Co in the cemented carbide.

The CW-ratio varies between 1 and about 0.75 dependent on the degree of alloying. A lower CW-ratio corresponds to higher W contents and CW-ratio=1 corresponds practically to an absence of W in the binder phase.

According to the present invention improved cutting performance is achieved if the cemented carbide has a CW-ratio of 0.78-0.95, preferably 0.80-0.92, and most preferably 0.82-

0.88. The cemented carbide may contain small amounts, <2 volume %, of η-phase ($M_6C$), without any detrimental effect.

Cemented carbide inserts according to the invention are preferably coated with a thin wear resistant coating with CVD-, MTCVD or PVD-technique or a combination of CVD and MTCVD. Preferably there is deposited an innermost coating of carbides, nitrides and/or carbonitride preferably of titanium, Subsequent layers consist of carbides, nitrides and/or carbonitrides preferably of titanium, zirconium and/or hafnium, and/or oxides of aluminium and or zirconium.

The present invention also relates to a method of making a coated cutting tool insert consisting of a cemented carbide substrate and a coating, said substrate comprising WC, binder phase and cubic phase, comprising at least one carbide or carbonitride containing vanadium, with a binder phase enriched surface zone essentially free of cubic phase, by powder metallurgical methods including; milling of a powder mixture forming the hard constituents and the binder phase, drying, pressing and sintering. Sintering is performed in nitrogen atmosphere, partly in nitrogen, in vacuum, or in inert atmosphere to obtain the desired binder phase enrichment. V is added as VC or as (V,M)C or as (V,M)(C,N) or as (V,M,M)(C,N) where M is any metallic element soluble in the cubic phase.

More particularly the method comprises the following steps:

- providing a powder mixture with a composition comprising 3-20 wt % cobalt, 70-92 wt-% WC, 1-15 wt-% vanadium as carbide, nitride or carbonitride, and as carbide <1 wt-% titanium, other cubic carbide forming elements from the groups 4a and/or 5a than vanadium and titanium in such an amount that the total amount of elements from groups 4a and/or 5a added being 1-15 wt-%,
- compacting said powder mixture to bodies of desired shape and dimension,
- sintering said bodies in nitrogen, partly in nitrogen or vacuum or inert atmosphere, to form substrates with the desired binder phase enriched surface zone and desired CW-ratio,
- edgerounding to 35-70 μm and cleaned using conventional methods and
- providing the bodies with a conventional wear resistant coating possibly with conventional aftertreatments such as brushing and blasting.

The invention also relates to the use of inserts according to the invention for turning of steel under normal conditions and especially with interrupted cutting. The inserts according to the present invention will be used for machining work pieces such as steel within the ISO-P area and stainless steel in the ISO-M area, preferably steel within the P35 area. The cutting speed should be <300 m/min, most preferably 190-240 m/min, at a cutting depth of 2-4 mm and a feed of 0.2-0.6 mm/rev.

EXAMPLE 1

Two alloys A) and B) according to the invention were manufactured as follows:

A) The raw materials 1, 2, 4 and 7, given in Table 1, were used for manufacturing a powder having the composition 10 wt-% Co-3.6 wt-% V, added as (V,W)C, 5.6 wt-% Ta, added as TaC balanced with WC with a sintered grain size of 1.6 μm. The CW-ratio was found to be 0.85. Inserts in style CNMG 120408-PM were pressed and sintered. The sintering was performed using $P_{N2}$=250 mbar up to T=1380° C. in order to nitride the alloy. From T=1380° C. and up to the sintering temperature, T=1450° C., the sintering was performed in an inert atmosphere of 40 mbar Ar.

TABLE 1

Raw materials.

| Raw material, No: | Raw material | Supplier | Grain size FSSS, μm |
|---|---|---|---|
| 1 | VC | H. C. Starck | 1.2-1.8 |
| 2 | WC | Sandvik | 16-18 |
| 3 | TiC | H. C. Starck | 1.2-1.8 |
| 4 | Co | OMG, Extra fine granulated | 1.3-1.6 |
| 5 | Ti (C, N) | H. C. Starck | 1.3-1.6 |
| 6 | (V, W) C | H. C. Starck | 1.5 |
| 7 | TaC | H. C. Starck | 1.5 |
| 8 | NbC | H. C. Starck | 1.5 |

The structure of the cutting inserts consisted of a 25 μm thick binder phase enriched surface zone under the clearance and rake faces and a significantly reduced gradient thickness close to the edge portion of the surface, see FIG. 1.

The inserts were edge rounded to 50 μm and cleaned using conventional methods and coated with a thin layer <1 μm of TiN followed by 9 μm thick layer of Ti (C,N) and a 7 μm thick layer of $\alpha$-$Al_2O_3$ according to U.S. Pat. No. 5,654,035. On top of the $\alpha$-$Al_2O_3$ layer a 1 μm thick TiN layer was deposited. Finally the inserts were wet blasted on the rake face with alumina grit to remove the top TiN-layer.

B) The raw materials 2, 4, 6, 7, 8 given in Table 1, were used for manufacturing a powder having the composition 5.48 wt % Co-2.7 wt % V, added as (V,W)C, 3.3 wt % Ta, added as TaC, –2.06 wt % Nb balanced with WC with a sintered grain size of 2.1 μm. The C/W ratio was found to be 0.83.

Inserts in style CNMG 120408-PM were pressed and sintered. The sintering was performed using $P_{N2}$=900 mbar up to T=1380° C. in order to nitride the alloy. From T=1380° C. and up to the sintering temperature, T=1450° C., the sintering was performed in an inert atmosphere of 40 mbar Ar. The inserts had a 25 μm thick binder enriched surface zone essentially free of cubic phase like the inserts in A.

The inserts were edge rounded, cleaned, coated and wet blasted as in A.

C) Commercially available cutting insert in style CNMG 120408-PM with the composition given below were used as references in the cutting tests comparing with alloy B:

Composition: Co=5.48 wt %, Ta=3.3 wt %, Nb=2.06 wt %, Ti=2.04 wt % and balance WC with a grain size 2.1 μm. Co-enriched surface zone of 20 μm. The CW-ratio was found to be 0.84. The inserts were coated and wet blasted: as in alloy A.

D) Commercially available cutting insert in style CNMG 120408-PM with the composition given below were used as references in the cutting tests compared with alloy B:

Composition: Co=10 wt %, Ta=5.6 wt %, Ti=2.36 wt % and balance WC with a grain size 1.6 μm. The CW-ratio was found to be 0.84. Co-enriched surface zone of 20 μm. Coated and wet blasted as in alloy A.

EXAMPLE 2

Inserts from B and C were tested and compared with respect to thermal cracking in a longitudinal turning with coolant of a square bar 100×100 mm to a diameter of 60 mm.

Material: SS1672

Cutting data:

Cutting speed=200 m/min

Depth of cut=3.0 mm

Feed=0.30 mm/rev

Figure 3:
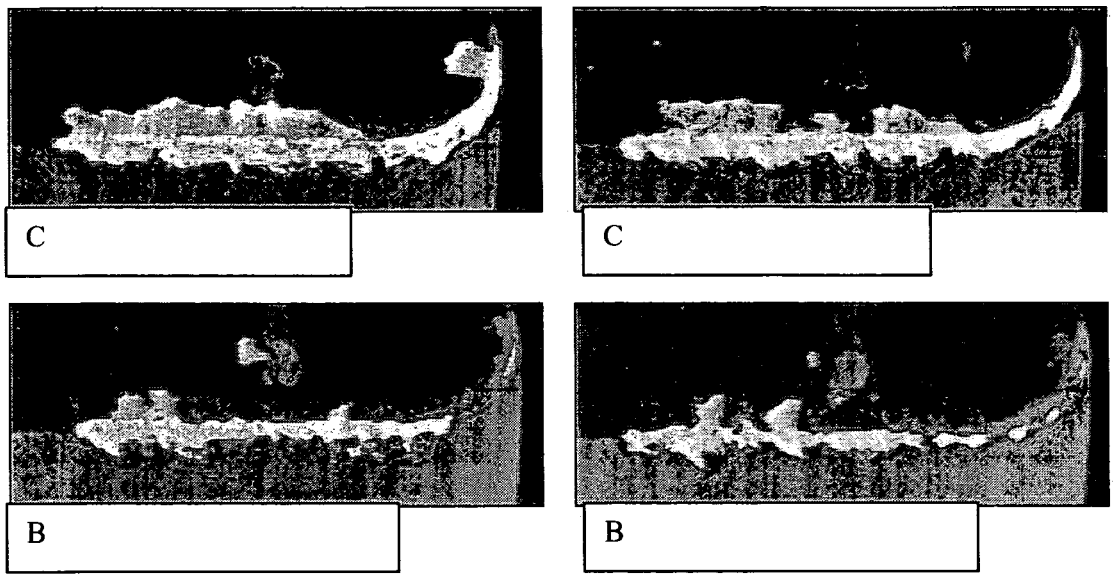
FIGS. 3 and 4 show in 40× magnification the appearance of the cutting edge of coated inserts according to the invention, A and B, and according to prior art, C and D after a turning test. The white areas show where the coating has spalled because of thermal cracking.

FIG. 3 shows in 40× magnification the appearance of the cutting edges of the inserts after 2 minutes turning. The white areas show where the coating has spalled because of thermal cracking. It is evident that inserts B have much better resistance against thermal cracking than inserts C.

EXAMPLE 3

Inserts from A and D were tested and compared with respect to thermal cracking in the same cutting operation as in example 2 but with different cutting data:

Cutting speed=220 m/min

Depth of cut=2.0 mm

Feed=0.30 mm/rev

Figure 4:
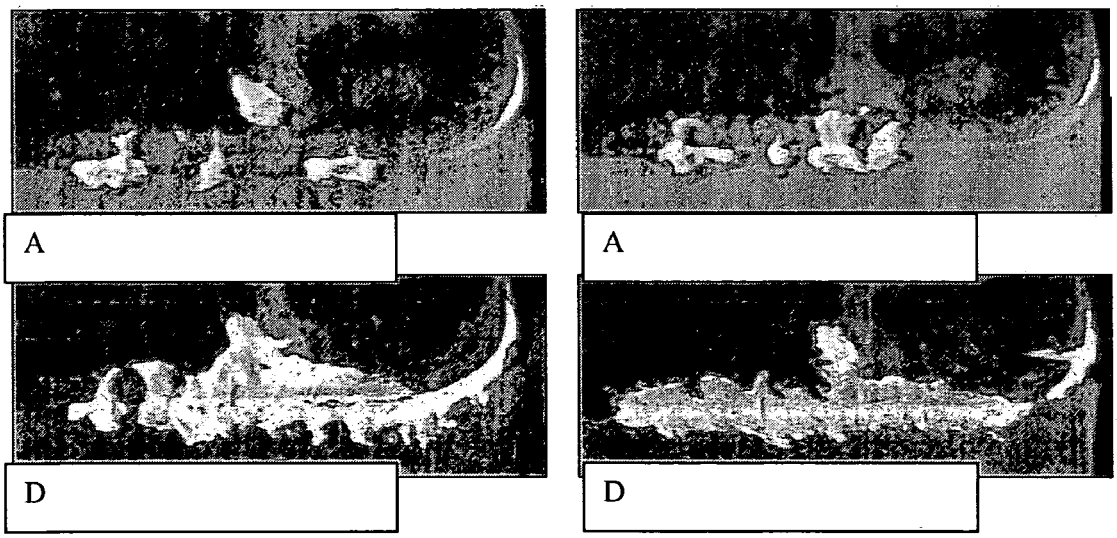

FIG. 4 shows in 40× magnification the appearance of the cutting edges of the inserts after 2 minutes turning. The white areas show where the coating has spalled because of thermal cracking. It is evident that inserts A have much better resistance against thermal cracking than inserts D.

EXAMPLE 4

Inserts from B and C were tested and compared with respect to flank resistance in longitudinal turning of ball bearing steel SKF25B with coolant present.

Cutting data:

Cutting speed=240 m/min

Depth of cut=2.0 mm

Feed=0.35 mm/rev

Tool life criteria: Flank wear ≧0.3 mm

Insert B: 18 min

Insert C: 16 min

Insert B is slightly better towards flank resistance than insert C.

EXAMPLE 5

Inserts from A and D were tested and compared with respect to flank resistance in longitudinal turning of ball bearing steel SKF25B with coolant present.

Cutting data:

Cutting speed=200 m/min

Depth of cut=2.0 mm

Feed=0.28 mm/rev

Tool life criteria: Flank wear ≧0.3 mm

Insert A: 28 min

Insert D: 21 min

Example 3 and 4 show the advantage that V has on the thermal properties compared to prior art inserts. Examples 4 and 5 show that the flank wear resistance is as good, or even better, than the commercially available alloys.

The invention claimed is:

1. Coated cutting tool insert consisting of a cemented carbide substrate and a coating, said substrate comprising WC, binder phase and cubic phase with a binder phase enriched surface zone essentially free of cubic phase, wherein the substrate comprises 3-20 wt-% cobalt, about 3.5-15 wt-% vanadium, <1 wt-% titanium, other cubic phase forming elements from groups 4a and/or 5a other than vanadium and titanium in such an amount that the total amount of elements from groups 4a and/or 5a added being 1-15 wt-% and 70-92 wt-% WC with a sintered average WC grain size larger than 1.5 μm.

2. Coated cutting tool insert according to claim 1, wherein the substrate comprises 4-15 wt-% cobalt.

3. Coated cutting tool insert according to claim 2, wherein the substrate comprises 5-13 wt-% cobalt.

4. Coated cutting tool insert according to claim 1, wherein the substrate comprises about 3.5-8 wt-% vanadium.

5. Coated cutting tool insert according to claim 1, wherein the total sum of vanadium and other cubic carbide formers from the groups 4a and 5a added is about 3.5-10 wt-%.

6. Coated cutting tool insert according to claim 1, wherein the substrate comprises 75-90 wt-% WC.

7. Coated cutting tool insert according to claim 1, wherein the substrate comprises <4 wt-% niobium and <10 wt-% tantalum.

8. Coated cutting tool insert according to claim 7, wherein the substrate comprises 0.2-3 wt-% niobium.

9. Coated cutting tool insert according to claim 7, wherein the substrate comprises <10 wt-% tantalum.

10. Coated cutting tool according to claim 1, wherein the substrate comprises, 4-15 wt-cobalt, 0.2-10 wt-% vanadium, 0.2-6 wt-% tantalum, the total sum of vanadium, tantalum, niobium, hafnium added is about 3.5-10 wt-% and balanced with 70-90 wt-% WC.

11. Coated cutting tool according to claim 1, wherein a depth of the binder phase enriched surface zone is less than 50 μm.

12. Coated cutting tool insert according to claim 11, wherein the depth of the binder phase enriched surface zone is 10-35 μm.

13. Coated cutting tool according to claim 1, wherein the binder phase is alloyed corresponding to a CW-ratio of 0.78-0.95.

14. Coated cutting tool insert according to claim 13, wherein the CW-ratio is 0.80-0.92.

15. Coated cutting tool insert according to claim 1, wherein the substrate comprises about 3.5 wt-% vanadium.

16. Method of making a coated cutting tool insert consisting of a cemented carbide substrate and a coating, said substrate comprising WC, binder phase and cubic phase with a binder phase enriched surface zone essentially free of cubic phase, the method comprising:

providing a powder mixture with a composition comprising 3-20 wt-% cobalt, 70-92 wt-% WC, about 3.5-15 wt-% vanadium as carbide, nitride or carbonitride, and as carbide <1 wt-% titanium, other cubic phase forming elements from the groups 4a and/or 5a than vanadium and titanium in such an amount that the total amount of elements from groups 4a and/or 5a added being about 3.5-15 wt-%, compacting said powder mixture to bodies of desired shape and dimension, sintering said bodies in nitrogen, partly in nitrogen or vacuum or inert atmosphere, to form cutting tool inserts with the desired binder phase enriched surface zone and desired CW-ratio, and providing the bodies with a wear resistant coating optionally with aftertreatments.

17. Method of making a coated cutting insert according to claim 16, wherein aftertreatments include brushing and blasting.

18. Method of making a coated cutting insert according to claim 16, wherein the substrate comprises about 3.5-8 wt-% vanadium.

19. Method of making a coated cutting insert according to claim 16, wherein the substrate comprises about 3.5 wt-% vanadium.

* * * * *